United States Patent [19]

Sun et al.

[11] Patent Number: 5,075,656

[45] Date of Patent: Dec. 24, 1991

[54] MICROWAVE SWITCH

[75] Inventors: Richard L. Sun, Redwood City; Krzysztof J. Ciezarek, Santa Clara, both of Calif.

[73] Assignee: Teledyne Microwave, Mountain View, Calif.

[21] Appl. No.: 498,877

[22] Filed: Mar. 26, 1990

[51] Int. Cl.[5] ..... H01H 51/30

[52] U.S. Cl. ..... 335/5; 333/105

[58] Field of Search ..... 335/4-5; 333/103-108

[56] References Cited

U.S. PATENT DOCUMENTS

| | | | |
|---|---|---|---|
| 3,487,342 | 12/1969 | Gibson et al. | 335/5 |
| 3,569,877 | 3/1971 | Robbins et al. | 335/5 |
| 4,908,388 | 3/1990 | Hoffman et al. | 335/5 |

*Primary Examiner*—Leo P. Picard
*Assistant Examiner*—Lincoln Donovan
*Attorney, Agent, or Firm*—Skjerven, Morrill, MacPherson, Franklin & Friel

[57] ABSTRACT

A microwave switch employs a slender reed contact which bridges across a pair of microwave probe ends to permit microwave signals to pass therebetween. The reed contact is connected to one end of a dielectric actuator post and a permanent magnet is affixed to a headed end of the post, a medial portion of the post extending through a microwave housing wall. A cup-shaped bushing preferably made of a polyimide plastic and a lubricating filler such as graphite or molybdenum disulfide, surrounds the edge and bottom periphery of the magnet and the post head and reciprocates on an inner periphery of a steel ring clamping an iron washer in a housing wall counterbore. The magnet is statically magnetically attracted to the iron washer moving the attached post and reed contact into bridging contact with the microwave probes to form a path for microwave signals between the probes. A solenoid is positioned above the permanent magnet. Actuation of the solenoid and its production of a dynamic magnetic field overcomes the static magnetic field and pulls the magnet from the iron washer moving the attached post and reed contact away from contact with the probes thus interrupting microwave signal transmission between the probes.

11 Claims, 2 Drawing Sheets

MICROWAVE SWITCH

RELATED APPLICATION

This application relates to U.S. Ser. No. 07/301,791 filed Jan. 25, 1989 entitled "Improved Solenoid Activator". Inventors: Jerzy Hoffman and Krzysztof J. Ciezarek.

FIELD OF THE INVENTION

This invention pertains to a microwave switch. More particularly, the invention is directed to a magnetic switch for actuating a reed contact which connects probe terminals of microwave transmission lines.

BACKGROUND OF THE INVENTION

Connections between microwave transmission lines have heretofore been constructed by employing a reed contact extending across a pair of parallel microwave probes representing an output line and an input line. In a contact position, the reed contact allows passage of microwave signals. In a reed contact disengaged position there is no connection between the probes and no microwave signal passes from the outlet probe to the inlet probe. In the prior art, a spring-loaded plastic post has been positioned above the reed contact and a solenoid plunger actuated to push the post against the post and move the reed contact into probe contact. In another prior art device, a pivotable iron bar is provided which is pivoted by a permanent magnet to a first position which presses a post against the reed contact to effect probe contacts and the bar pivoted to a second position by a solenoid so that the bar is out of operating contact with the reed contact thus disconnecting the switch. The above prior art devices generally have a relatively short cycle life of about one million cycles due to friction, impact stresses, pivot wear and metal fatigue. Further, these prior art devices have multiple moving parts and assemblies resulting in an expensive construction and relatively low durability.

SUMMARY OF THE INVENTION

The present invention provides a magnetic switch particularly suitable for the connection and disconnection of microwave output and input lines wherein a reed contact bridgedly connects between microwave end connectors, in the form of parallel spaced probes, by static magnetic field attraction between a permanent magnet and an iron plate or washer. Disconnection is performed by actuation of a solenoid, the magnetic field of which overcomes the static magnetic field to pull the magnet and an attached post and reed contact away from the iron washer, this causing the reed contact to disengage from its contact across the microwave probes. In a preferred embodiment, a counterbore is provided in a microwave housing wall into which the iron washer is fitted. The washer is held in the bore by a steel ring. A cylindrical magnet is affixed to a head at one end of a post extending through the washer aperture, the post and magnet being affixed into a cup-shaped bushing made of a polyimide plastic containing a lubricating filler such as graphite. The bushing is slidingly reciprocable in the steel ring so that in the connection mode the magnet-post-bushing assembly is attracted to the iron washer. In so moving the other end of the post pushes the reed contact into the desired probe-to-probe physical bridging connection. In the disconnect mode a solenoid and its coil is actuated which sets up a dynamic magnetic field to counter the static magnetic field. This dynamic field pulls the magnet-post-bushing assembly upward in the counterbore and steel ring and away from the iron washer to thereby pull the reed contact away from its bridging contact between the microwave probes thus interrupting the microwave signals flowing from probe-to-probe through the reed contact. The post is made of suitable dielectric such as plastic which prevents flow of microwave energy to the housing, magnet, washer and ring.

The use of a polyimide bushing and lubricating filler such as graphite or molybdenum disulfide greatly improves the switch cycle life. It is to be understood that in some microwave applications switching may occur in constantly repeated increments of as little as 5 milliseconds. Thus, the present device is designed to have a 25 or even a 50 million cycle life. The switch of the invention has also only one moving subassembly (magnet, post, bushing and reed contact) and is more cost effective and of greater durability than prior known devices. Further, the switch of the invention can be used in a switch matrix that multiple contacts can be made by a one or more reed contacts mounted on the post bottom end.

DETAILED DESCRIPTION OF THE PREFERRED EMBODIMENTS

Figure 1:
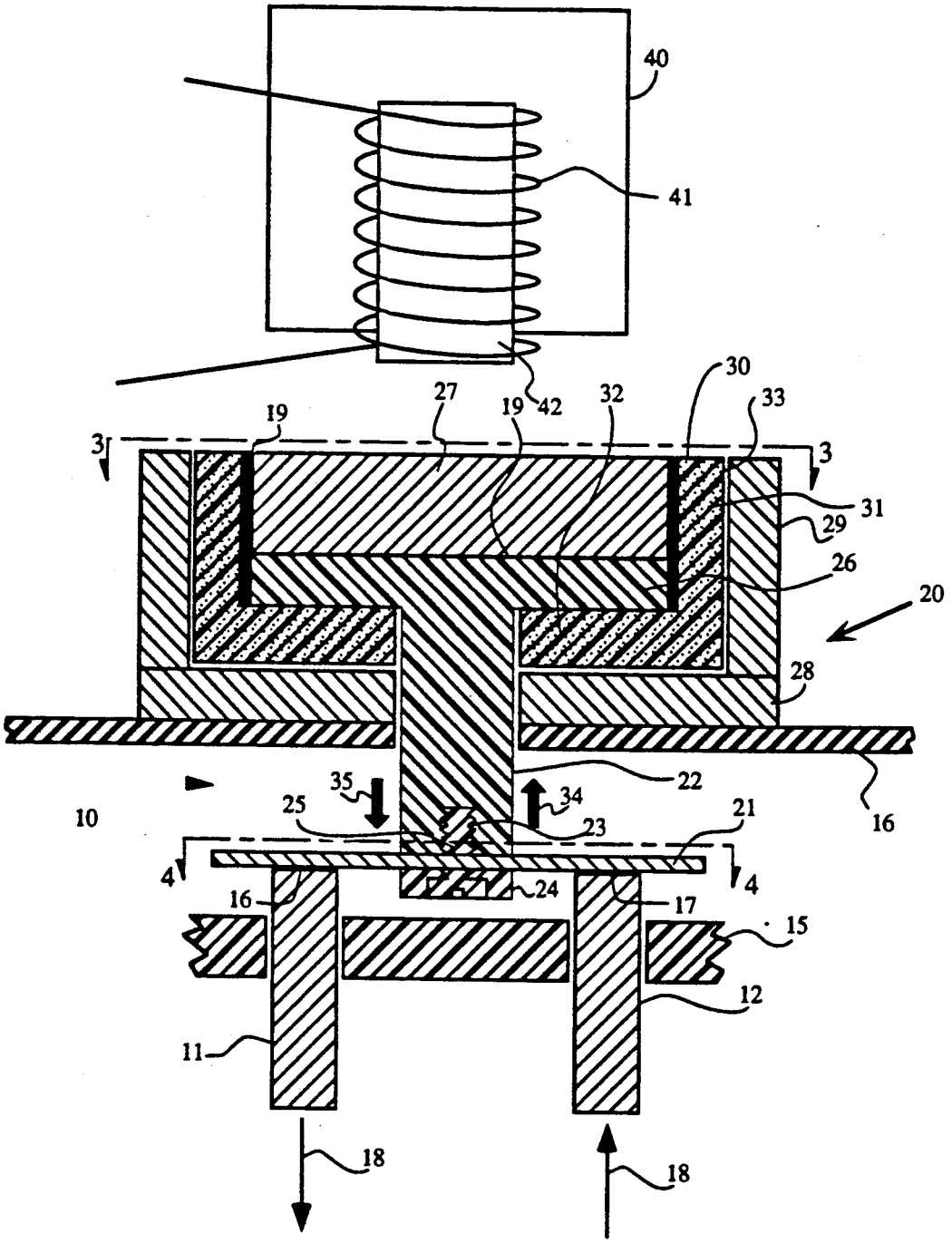
FIG. 1 is a schematic side partial cross-sectional view of the magnetic switch and microwave probe connectors.

As shown in FIG. 1, a microwave switching assembly 10 includes a pair of cylindrical microwave probes 11, 12 which are the center conductor of microwave connectors. Microwave connectors (not shown) which generally are of the bayonet pin and slot type or screw threaded type are well known in the art. Probe 12 is a microwave signal input probe and probe 11 is a microwave signal output probe as indicated by arrows 18. The probes typically extend through a casing wall 15. It is understood that various pairs of probes may extend through wall 15 with a switch mechanism juxtaposed to each pair of probes. Further, one switch mechanism may be juxtaposed to one or more additional pairs of probes to allow for simultaneous connection or disconnection of such pairs of probes.

Figure 2:
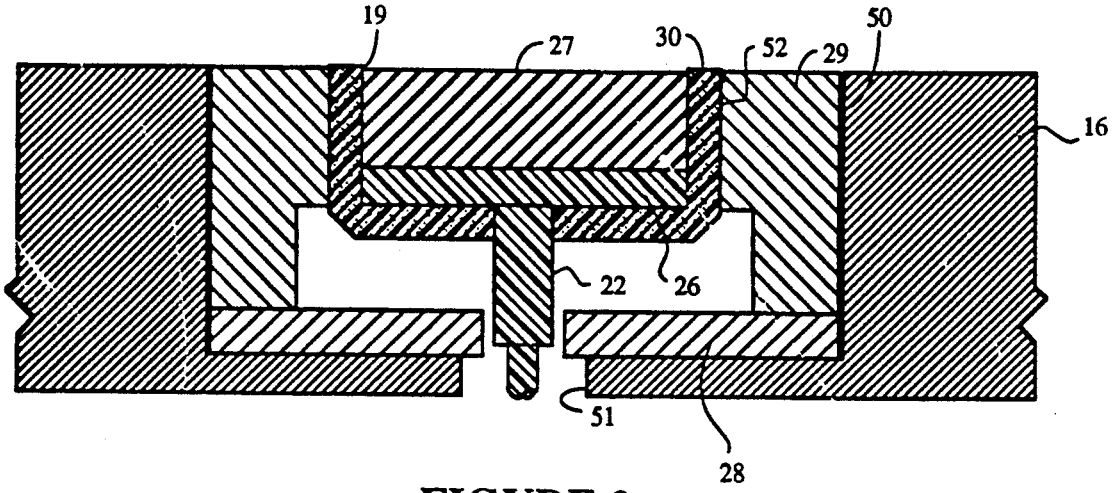
FIG. 2 is a cross-sectional side view of a preferred embodiment of the magnetic switch subassembly.

A magnetic switch 20 is positioned juxtaposed to the pair of probes 11, 12 so that a reed contact 21, made of a thin reed-like strip of metal such as beryllium-copper bridges across the probe ends 16, 17 making a physical contact and allowing microwave signal transmissions from probe 12 to probe 11 through the reed contact 21. The connection mode of switch operation is performed by a static magnetic subassembly including a dielectric post 22 having a bore 23 and a dielectric end cap 24 at one end. The reed contact 21 is apertured and clamped on the end of post 22 by the end cap 24 and a dielectric fastener such as screw 25 passing through a counterbore aperture in the end cap and into post threaded bore 23. The post 22 also includes a headed portion 26 at its opposite top end. A cylindrical permanent magnet 27 generally having the same diameter as the post head 26 is affixed thereto by epoxy adhesive 19 or the like. In the preferred embodiment, the magnet is a commercially available samarium cobalt-14 magnet dimensioned as herein described. The medial portion of the post 22 normally passes through an aperture in a microwave housing dielectric wall 16 and is movable in and out of that aperture. An iron plate in the form of an iron washer 28 is positioned on wall 16 (preferably in a wall cavity as seen in FIG. 2). A steel ring 29 spacedly surrounds magnet 27 and has its lower peripherial edge affixed to or held against the washer 28 A cup-like bushing 30 having a cylindrical side wall 31 and base 32 provides a cavity 33 into which the post head 26 and magnet 27 are affixed by epoxy adhesive 19 or the like.

The bushing 30 is preferably constructed of a Vespal ® polyimide resin available from DuPont Corporation. A preferred material is Vespal SP-22 which contains 40% by weight of encapulated graphite filler. The resultant bushing is self-lubricating, non-conductive, is durable and has a long life. Other Vespal resin products containing smaller amounts of graphite, e.g., 15% by weight, or containing graphite and Teflon ® fluorocarbon resin fibers, or about 15% by weight dry blended molybdenum disulfide powder may also be employed. A range of about 15% to about by weight of encapsulated graphite is preferred. In other embodiments, the bushing may be constructed of brass, Kel-F ® chlorotrifluoroethylene resin, Nylon, or Rexolite# microwave dielectric styrene resin (#1422/#2200 from Dodge Industries).

The bushing 30 is sized to slidingly reciprocate on the interior periphery of ring 29 so that accurate linear motion attached post and reed contact can be obtained.

The magnet 27 has sufficient permeability (flux) that it will be attracted to the iron washer 28 thus moving the overall magnet-post-reed contact subassembly into bridging contact with the probe ends. The iron washer employed may have various thicknesses or more than one washer may be employed to provide sufficient mass for attraction of magnet 27.

The switch assembly also includes a solenoid 40 having a coil 41 and armature 42 positioned by suitable structure (not shown) and spaced above the magnet 27. Actuation of the solenoid creates a dynamic magnetic field sufficient to the static magnetic field pulling the permanent to the iron washer, thus raising the magnet-bushing-magnet-post-reed contact subassembly as indicated by Up arrow 34. Reed contact 21 thus lifts off the probe ends 15, 16 interrupting or disengaging microwave signal flow across the probes. Upon cessation of the solenoid actuation, the static magnetic field again allows the magnet 27 to be attracted to the fixed iron washer 28 and simultaneously to move the post 22 and reed contact 21 downwardly as indicated by Down arrow 35 placing the reed contact again into bridging operating contact across the probe ends.

FIG. 2 shows a preferred embodiment of the actuator in which a counterbore 50 and bottom aperture 51 is provided in the microwave housing wall 16. The iron plate or washer 28 is positioned in the bottom of counterbore 50. A steel ring 29 is affixed therein by suitable epoxy 19 or other adhesive or by other holding means to clamp the plate 28 and provide a cylindrical inner peripheral bearing surface 52. The outer periphery of bushing 30 slides on bearing surface 52 as the bushing reciprocates in going from one switch mode of operation to the other switch mode of operation where the reed contact contacts or is disengaged from contact with the probe ends. In this FIG. 2, the detector is seen in the Up position where the magnet has been drawn to the solenoid. Upon inactivation of the solenoid; the magnet 27 again will be attracted to the iron washer 28 and the reed contact placed in bridging contact with the probe ends as seen in FIG. 1.

Figure 3:
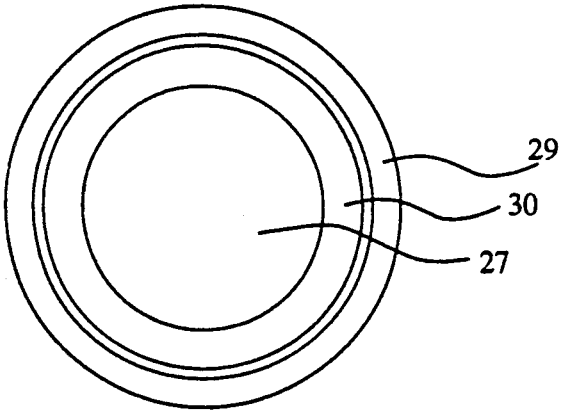
FIG. 3 is a plan view of the subassembly taken on the line 3—3 of FIG. 1.

FIG. 3 illustrates the top of magnet 27, the top of cup-shaped bushing 30 and the surrounding steel ring 28, through which the bushing-magnet reciprocates.

Figure 4:
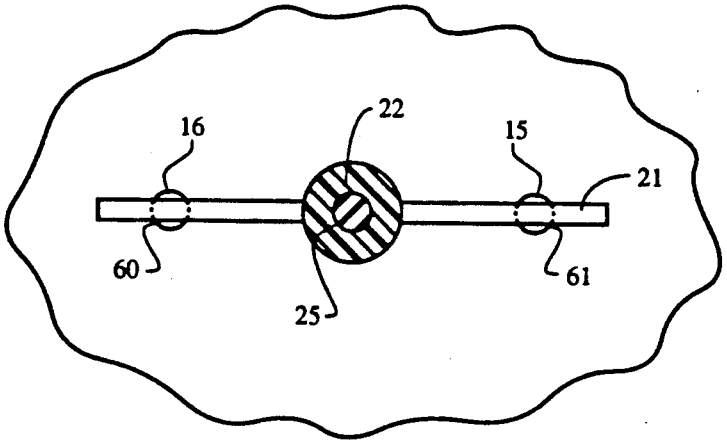
FIG. 4 is a cross-sectional plan view of the reed contact and probes taken on the line 4—4 of FIG. 1.

FIG. 4 shows the top of reed contact 21 in contact at 60, 61 with the probe ends 16, 15 in the contacting signal-transmission mode of operation. It also shows the cross-section of dielectric post 22 and dielectric screw 25.

The reed contacts and other elements of the described microwave switch are highly miniaturized. The reed contacts are typically 0.015 to 0.030 inches (0.38–0.76 mm) in thickness, 0.030 to 0.070 inches (0.76–1.78 mm) in width and ¼ to 1½ inches (0.63–3.81 cm) in length. The iron washer is typically 0.050 to 0.20 inches (1.27–5.08 mm) in thickness and of a 0.25 to 0.50 inch (0.63–1.27 cm) diameter. The dielectric post is typically made of a Kel-F ® plastic and is 0.25 to 0.50 inches (0.63–1.27 cm) long and 0.030 to 0.080 inches (0.76–2.03 mm) in diameter.

The above description of embodiments of this invention is intended to be illustrative and not limiting. Other embodiments of this invention will be obvious to those skilled in the art in view of the above disclosure.

What is claimed is:

1. In an actuator for moving a reed conductor positioned to bridge across a pair of contacts extending within a housing; a dielectric post attached at one end to the reed conductor and extending through a wall of the housing; a coaxial permanent magnet attached to an opposite end of the post; a coaxial electromagnet positioned to create a magnetic field around the permanent magnet to move said magnet and post; and a coaxial ferro-magnetic material positioned around the post between said permanent magnet and said reed conductor to attract the permanent magnet, the improvement wherein:

said ferro-magnetic material comprises a soft iron washer juxtaposed to said housing, surrounding said post and positioned between said reed contactor and said permanent magnet; and further comprising a guide ring surrounding said post and permanent magnet and in contact with said iron washer;

and a bushing attached to a peripheral edge of said permanent magnet, said bushing being slidingly movable in said guide ring.

2. The actuator of claim 1 wherein said permanent magnet is a samarium-cobalt magnet.

3. The actuator of claim 1 wherein said guide ring is a steel metal ring.

4. The actuator of claim 1 in which said bushing is a polyimide plastic containing a lubricating filler.

5. The actuator of claim 4 in which said filler is graphite.

6. The actuator of claim 5 in which said graphite comprises from about 15% to about 40% by weight of said bushing.

7. The actuator of claim 4 in which said filler is molybdenum disulfide.

8. The actuator of claim 1 wherein said housing wall includes a post aperture and a counter-sink bore surrounding said aperture, said iron washer being confined in said bore, said ring being fixed in said bore to seat said washer at a bore bottom, and wherein said post reciprocates through said aperture and said attached magnet reciprocates in said ring when said magnet is attracted to said iron washer.

9. The actuator of claim 8 in which said post includes an elongated stem portion connected to said reed conductor and a circular head portion, said magnet having a cylindrical configuration and being attached to said post head portion.

10. The actuator of claim 1 wherein said bushing is cup-shaped and extends around a post head portion and a cylindrical periphery of said magnet.

11. The actuator of claim 1 in which said post is a chlorotrifluoroethylene resin, said bushing is a polyimide resin and said post is connected to said reed conductor by a chlorotrifluoroethylene screw.

* * * * *